US005403085A

United States Patent [19]

Banks

[11] Patent Number: 5,403,085

[45] Date of Patent: Apr. 4, 1995

[54] PROCESS FOR INTRODUCING MATERIAL INTO A TREATMENT DEVICE

[75] Inventor: Edgar N. Banks, Green Valley, Mo.

[73] Assignee: Tarmac Industries, Inc., Blue Springs, Mo.

[21] Appl. No.: 123,583

[22] Filed: Sep. 17, 1993

Related U.S. Application Data

[63] Continuation of Ser. No. 816,960, Jan. 3, 1992, abandoned.

[51] Int. Cl.[6] ..... B28C 5/46

[52] U.S. Cl. ..... 366/23; 366/25; 366/54; 366/57

[58] Field of Search ..... 366/3, 4, 5, 6, 7, 8, 366/10, 12, 14, 15, 22, 23, 24, 25, 144, 147, 348; 432/105, 103, 108, 109, 111; 34/136

[56] References Cited

U.S. PATENT DOCUMENTS

| | | | |
|---|---|---|---|
| 4,802,139 | 1/1989 | Sasaki | 366/25 |
| 4,867,572 | 9/1989 | Brock et al. | 366/15 |
| 4,892,411 | 1/1990 | Elliott et al. | 366/144 |
| 4,898,472 | 2/1990 | Sasaki | 366/25 |
| 4,910,540 | 3/1990 | Murray | 366/23 |
| 4,989,986 | 2/1991 | Swisher, Jr. | 366/25 |
| 5,052,810 | 10/1991 | Brock | 366/25 |

FOREIGN PATENT DOCUMENTS 3423521 1/1986 Germany .

*Primary Examiner*—David A. Scherbel
*Assistant Examiner*—Tony G. Soohoo
*Attorney, Agent, or Firm*—Hovey, Williams, Timmons & Collins

[57] ABSTRACT

In an apparatus for heating and mixing a particulate material composition, an elongated drum is supported for rotation on a frame and hot gases are supplied to the drum at an output end of the drum and directed toward an input end. An outer shell encircles the drum adjacent the output end and defines an outer mixing chamber between the drum and the shell. A first particulate material is introduced into the drum adjacent the input end, is conveyed toward the output end, and is diverted into the mixing chamber. A second particulate material is introduced into the outer mixing chamber and is heated to an output temperature during mixing with the first material. Thereafter, the mixed materials are delivered from the outer mixing chamber and from the apparatus.

2 Claims, 3 Drawing Sheets

PROCESS FOR INTRODUCING MATERIAL INTO A TREATMENT DEVICE

This application is a continuation of application Ser No. 07/816,960, filed Jan. 3, 1992, now abandoned.

BACKGROUND OF THE INVENTION

1. Field of the Invention

The present invention relates generally to treatment devices for use in heating and mixing various particulate material compositions and, more particularly, to an apparatus for continuously heating and mixing a number of particulate materials which are introduced into the apparatus at different locations.

2. Discussion of the Prior Art

It is known to employ a drum-mix plant for recycling remediated asphalt pavement (RAP) by introducing the RAP into a rotatable drum of the plant downstream of a burner flame and mixing the RAP with new aggregate particles which enter the drum adjacent the flame at the inlet of the drum. In this type of construction, it is possible to distance the RAP from the flame in order to reduce "blue smoke", an environmental problem arising from exposing the RAP to relatively high temperatures, e.g. greater than about 275 degrees Fahrenheit.

Typically, a dense veil of virgin aggregate particles are showered in front of the entering RAP particles in order to further shield the RAP particles from exposure to the flame. In other known constructions, mechanical shields are provided to carry out a similar function with the goal of reducing "blue smoke" to an acceptable level.

Certain drawbacks exist with each of these known constructions. For example, if the aggregate particles are used as a shield for the RAP particles, then special flighting is required within the drum or additional inlet openings are required to direct virgin material into the path of the flame to prevent exposure of the RAP particles to the flame. Further, where mechanical shields are used, supplementary hardware is required in addition to the hardware used to introduce the RAP particles into the drum in order to convert an existing drum plant into a plant capable of recycling RAP. Thus, such constructions are expensive to install and tend to render the plant less efficient than would be the case if the heat from the flame were more fully utilized in the heating process.

According to another known process, virgin aggregate is super-heated in a rotary dryer to a temperature of about 600°-800° F. and is then delivered to a separate batch or continuous mixer within which the aggregate is mixed with RAP particles. This composition then experiences a further treatment where it is mixed with liquid asphalt. However, because of the inefficient use of heat transfer in this known system, only a small percentage of RAP may be added to the aggregate. If larger percentages of RAP are added, the moisture within the RAP particles is not completely evaporated during mixing. Thereafter, continued evaporation of the moisture in the RAP particles after the composition has been delivered from the mixer causes unwanted cooling of the composition, and stripping of the liquid asphalt from the particles may result.

Another conventional use to which rotary dryers are put is for remediating soil which is contaminated with hydrocarbons and the like. During soil remediation, contaminated soil is introduced into the drum at the inlet of the drum and is conveyed in a direction either parallel or counter to the direction of flow of the hot gases. During conveyance of the soil, the hydrocarbons are evaporated and carried away with the hot gases to a conventional filtration system such as a baghouse, and the soil delivered from the outlet are lower in contaminates than when introduced into the drum.

One problem encountered in the use, of rotary dryers in the remediation of soil arises due to the collection of contaminated waste dust within the baghouse or filtration device through which the hot gasses and evaporated hydrocarbons pass after leaving the rotary dryer. It would be desirable to provide a means for remediating this waste dust without requiring additional machinery or expense beyond that required to operate the plant.

OBJECTS AND SUMMARY OF THE INVENTION

It is an object of the present invention to provide a material entry system for use on a rotary dryer wherein material may be directed from the drum into an outer chamber where additional material is introduced so that the additional material is heated and mixed with the originally treated material before being delivered from the apparatus.

Another object of the present invention is provide an apparatus capable of being retro-fitted on a previously constructed conventional rotary dryer and which permits the introduction of material into the apparatus at different locations so that each of the materials are treated differently within the apparatus, but which are mixed together to form a composition of particulate materials that is delivered from the apparatus.

In accordance with these and other objects evident from the following detailed description of a preferred embodiment of the invention, an apparatus for heating and mixing a particulate material composition includes a frame, an elongated drum supported for rotation on the frame and having an input end and an output end, means for supplying hot gases to the drum at the output end and for directing the hot gases toward the input end, and means for introducing a first particulate material into the drum adjacent the input end and for conveying the first particulate material toward the output end. An outer shell encircles the drum adjacent the output end and defines an outer mixing chamber between the drum and the shell.

A diversion means diverts the first particulate material into the mixing chamber as the first material is conveyed toward the output end of the drum, and an introduction means is provided for introducing a second particulate material into the outer mixing chamber. The second material is heated to an output temperature during mixing with the first material in the outer mixing chamber, and a delivery means is provided for delivering the composition of first and second materials from the outer mixing chamber and from the apparatus.

By constructing a treatment apparatus in accordance with the present invention, numerous advantages are achieved. For example, when a device constructed in accordance with the invention is used to heat virgin aggregate for use in the asphalt industry, aggregate particles are introduced into the input end of the drum and are conveyed toward the output end in a direction counter to the direction in which the flow of hot gases pass through the drum. The aggregate particles are super-heated before being diverted into the outer mixing chamber so that heat from the particles is transferred to RAP particles or other possible additives to the aggregate which are introduced directly into the outer mixing chamber from outside the apparatus. Thus, the added particulate material is heated by contacting and mixing with the aggregate particles within the outer mixing chamber and are not exposed to the relatively high temperatures present within the output end of the drum.

By carrying out mixing of RAP and virgin aggregate particles within an outer mixing chamber adjacent the drum, the RAP is combined with the composition and heated to a desired output temperature while reducing blue smoke to an acceptable level.

When used in remediating soil, the drum is used to convey contaminated soil from the input end toward the output end while exposing the soil to hot gases which evaporate hydrocarbons in the soil to reduce the hydrocarbon content thereof. The hot gases and evaporated hydrocarbons exiting the input end of the drum may then be filtered in a baghouse or similar filtration device before being exhausted or recirculated. Contaminated dust collected within the baghouse may then be delivered into the outer mixing chamber so that the dust may be heated and mixed with the soil being remediated. Thus, at least a portion of the hydrocarbons in the dust are again evaporated during heating of the dust, and the composition output from the apparatus includes the remediated dust.

In accordance with another aspect of the present invention, a method of heating and mixing a particulate material composition comprises the steps of supplying hot gases to an output end of a rotatable drum and directing the hot gases toward an input end of the drum, introducing a first particulate material into the drum adjacent the input end and conveying the first particulate material toward the output end, and diverting the first particulate material into an outer mixing chamber defined by an outer shell encircling the drum adjacent the output end. A second particulate material is introduced into the outer mixing chamber, and is heated to an output temperature while mixing the first and second materials in the outer mixing chamber. Thereafter, the mixture of first and second materials is delivered from the outer mixing chamber and from the apparatus.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
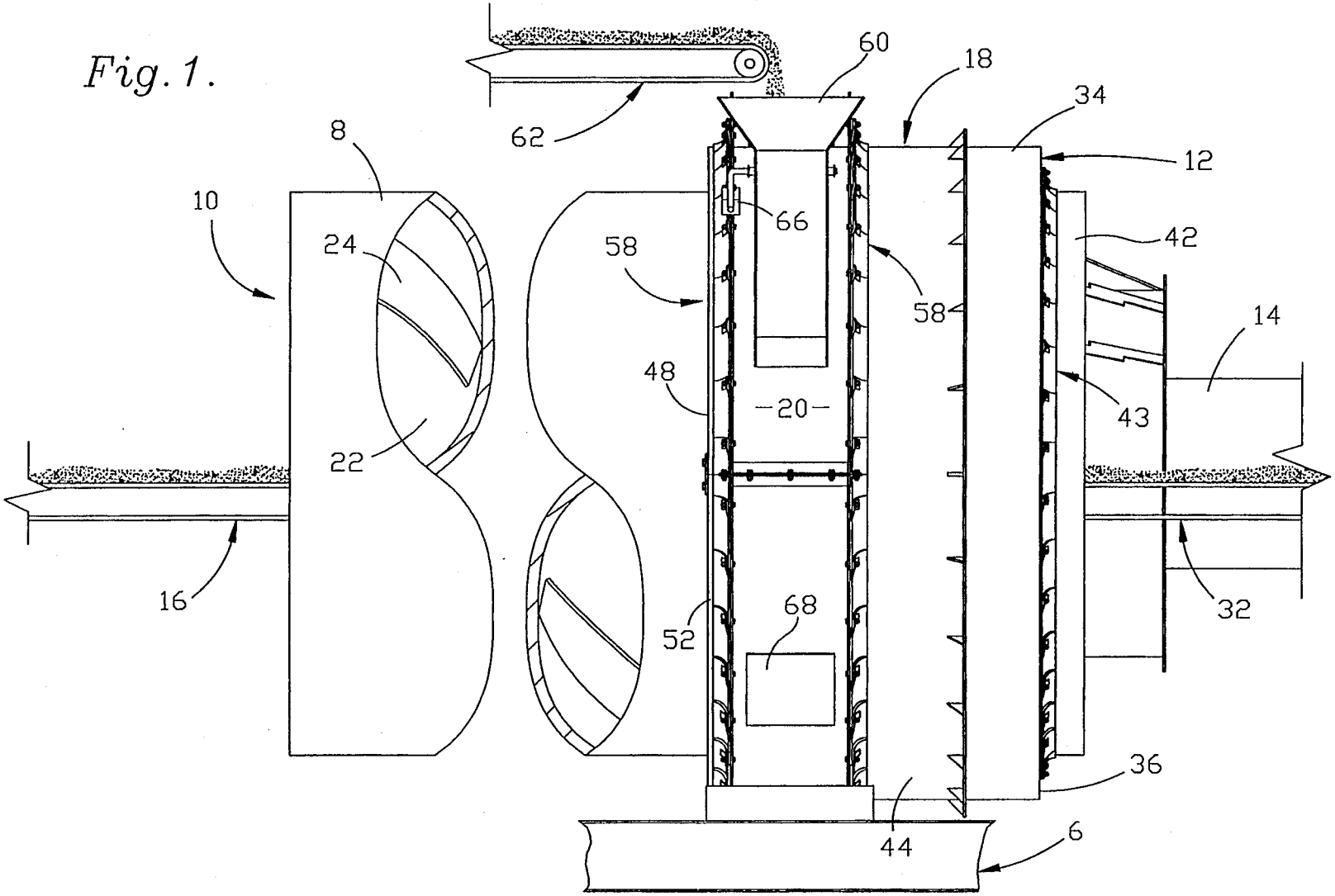
FIG. 1 is a side elevational view of a treatment apparatus constructed in accordance with a preferred embodiment of the present invention.

A treatment apparatus constructed in accordance with a preferred embodiment of the present invention is illustrated in FIG. 1, and includes a frame 6, an elongated drum 8 supported for rotation on the frame and including an input end 10 and an output end 12, a burner 14 supported on the frame and directed inward of the output end of the drum, and a conveyor 16 for conveying a first particulate material into the input end of the drum.

Figure 3:
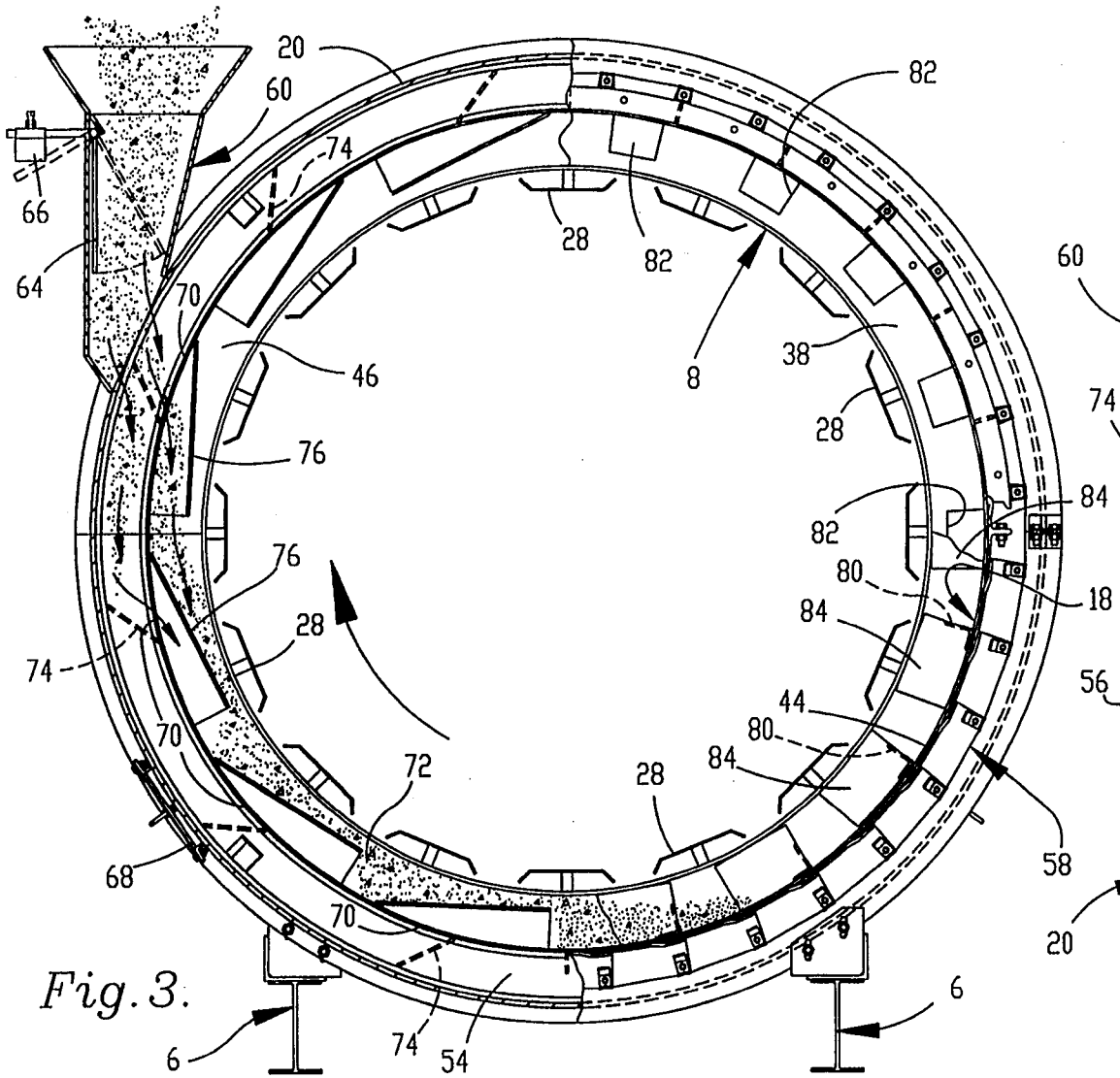
FIG. 3 is an end elevational view of the apparatus with certain areas cut away, illustrating movement of material within the outer mixing chamber of the apparatus.

An outer shell 18 encircles the drum adjacent the output end and defines an outer mixing chamber between the drum and the shell, as shown in FIG. 3. An annular cover 20 encircles a region of the shell and is fixed to the frame so that the annular cover does not rotate with the drum.

Returning to FIG. 1, the frame 6 is constructed to support the elongated drum and the burner, and includes a motor or other suitable means for rotating the drum. Preferably, drive rollers are provided on the frame and the drum rests on the drive rollers and is driven thereby upon operation of the motor in a conventional manner. If desired, the frame may be constructed to permit transportation of the entire apparatus from one location to another, or may be constructed at the desired sight of use.

Figure 2:
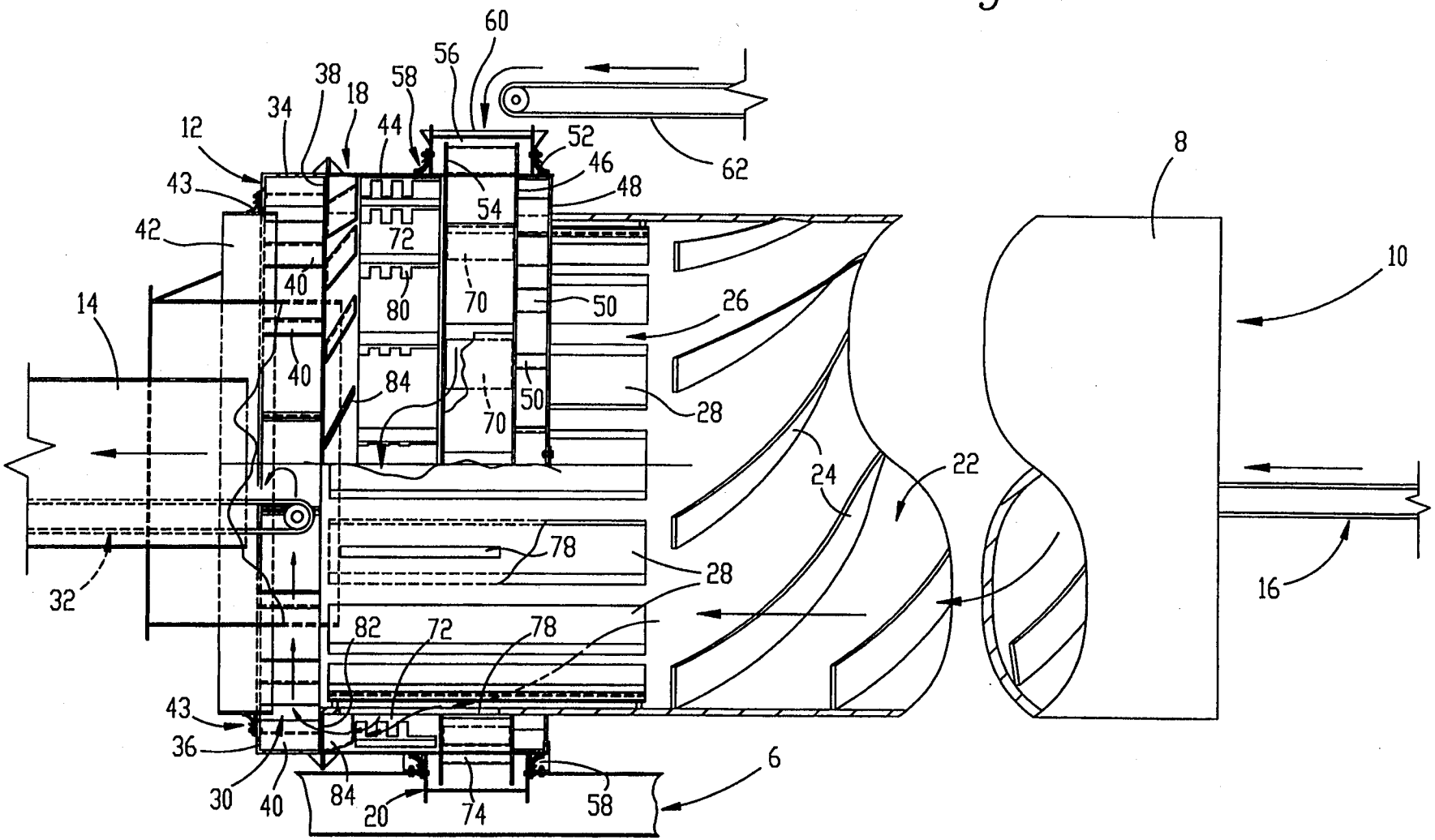
FIG. 2 is a longitudinal sectional view of the treatment apparatus with certain areas cut away, illustrating the interior construction of the drum and outer mixing chamber thereof.

The drum 8 is generally cylindrical and includes a number of different interior zones, as shown in FIG. 2, within which different flighting configurations are provided for conveying material within the drum from the input end 10 toward the output end 12. For example, within a first interior zone 22 adjacent the input end, helical flights 24 are provided for moving material within the drum toward a combustion zone 26 adjacent the output end 12. Combustion flights 28 may be provided within the combustion zone for protecting the material within the combustion zone from being exposed directly to the flame produced by the burner 14. Alternately, where exposure of the material to the flame is desired, the combustion flights may be eliminated or replaced by other suitable structure.

A lifting zone 30 is connected to the drum at the output end 12 for lifting material exiting the output end to a conveyor 32 or other delivery structure which carries the material to a downstream operation. The lifting zone is defined by a cylindrical circumferential wall 34, annular end walls 36, 38, and a plurality of radially extending flights 40 for lifting material from the bottom of the zone to a height at which the material falls from the flights onto the conveyor 32. The annular end wall 38 is attached to the drum, and the annular end wall 36 is provided with sealing structure 43 for sealing any gap defined between the end wall and a stationary skirt 42 surrounding the burner 14 in order to preserve a negative pressure within the drum as discussed below.

The burner 14 is supported on the frame 6 and remains stationary during rotation of the drum while directing a flame into the drum to provide hot gases which are utilized in heating and drying particulate material within the apparatus. Typically, the flame generated by the burner extends into the drum within the combustion zone only while the hot gases produced thereby travel toward and out the input end to air pollution control equipment such as a baghouse or the like, not shown, within which the gases are filtered prior to being exhausted to atmosphere or recirculated. A fan is typically provided at the clean end of the air pollution control equipment for drawing air, through the apparatus to create a negative pressure within the drum.

As viewed in FIG. 1, the shell 18 encircles the drum 8 adjacent the output end and includes a circumferential wall 44 and an annular end wall 46. The circumferential wall extends from 3 to 10 feet from the output end of the drum toward the input end, and preferably from 6 to 8 feet. The circumferential wall 44 is welded or otherwise affixed at one end to the annular end wall 38 of the lifting zone 30, and is affixed at the other end to the annular end wall 46 of the shell.

As best shown in FIG. 2, an additional annular wall 48 and a plurality of radially extending plates 50 may be connected to the annular end wall of the shell and the drum to increase the strength of the connection therebetween. A circumferential wall 52 is secured between the end wall and the additional wall over the plates to permit sealing of the cover as described below.

The annular end wall extends radially from an inner circumferential edge engaging the outer surface of the drum and an outer circumferential edge having a diameter slightly larger than the diameter of the shell 18. An annular flange 54 is spaced axially from the annular end wall 46 on the outer surface of the shell and is fixed to the shell to define an annular channel on the exterior surface of the shell.

The cover 20 encircles the region of the shell including the annular channel to define an annular space 56 exterior of the shell. Sealing structure 58 seals the cover against the circumferential walls 44, 52 enclosing the annular space 56. A material entry chute 60 is connected to the cover for introducing particulate material into the annular space, and a conveyor 62 is provided for delivering particulate material to the chute.

Preferably, he chute 60 includes a counter-weighted air seal which prevents air from being drawn into the annular space through the chute at times when no material is being introduced into the space. For example, the seal may include a flap 64 within the chute which is mounted for pivotal swinging movement about a horizontal axis. A weight 66 is attached opposite the flap at a position biasing the flap toward a closed position in which the flap blocks the chute, but permitting the flap to pivot to a non-blocking position when material within the chute contacts the flap. One or more inspection doors 68 may also be provided on the cover to permit an operator access to the annular space.

Figure 4:
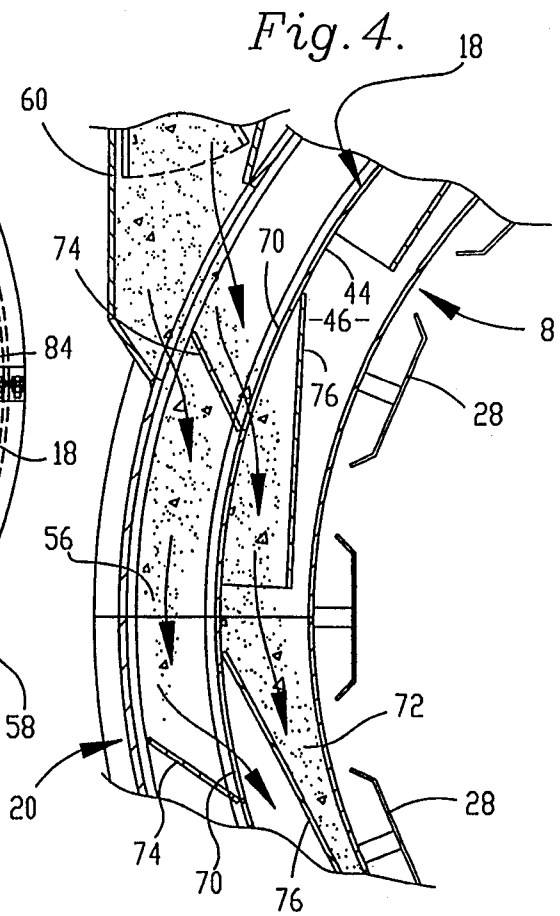
FIG. 4 is a fragmentary sectional end elevational view of the apparatus shown in FIG. 3, illustrating movement of the material into the outer mixing chamber.

As best shown in FIG. 4, a number of circumferentially disposed, radially extending openings 70 are formed in the shell 18 between the end wall 46 and the flange 54 within the annular space 56. These openings 70 permit material within the annular space to be introduced into an outer mixing chamber 72 defined between the drum and the shell. A plurality of angled guide plates 74 may be secured within the annular space between the wall 46 and the flange 54 to direct material within the space into the openings 70.

Interior of the shell 18, a baffle 76 is associated with each of the openings for directing material passing through the openings into the outer mixing chamber. In the drum 8, a number of slots 78 are formed which extend longitudinally between the output end of the drum and the annular end wall 46 of the shell. Each of these slots 78 is disposed immediately radially outward of one of the combustion flights, when such flights are provided, and defines a means for diverting the particulate material within the drum into the outer mixing chamber.

A number of mixing flights 80 are secured to the inner surface of the outer shell and extend into the mixing chamber for mixing the materials within the chamber during rotation of the drum. Preferably, the flights 80 are constructed to mix the materials while permitting the materials to remain within the mixing chamber until gravity forces the material toward the lifting zone 30, and do not accelerate movement of the material from the chamber.

The end wall 38 of the lifting zone includes a plurality of longitudinally extending openings 82 connecting the lifting chamber with the mixing chamber, and a number of radially extending scoops 84 are secured to the shell for delivering material from the mixing chamber into the lifting zone. Preferably, the scoops are angled to expedite movement of material into the lifting zone.

In operation, the apparatus may be used to heat and mix a number of different particulate material compositions. For example, the apparatus maybe used to heat and dry virgin aggregate particles to be used in making an asphalt composition, while permitting RAP or other additives to be added to and mixed with the aggregate particles prior to the application of liquid asphalt to the mixture in an operation downstream from the dryer.

When used to carry out this type of mixing operation, the virgin aggregate particles are introduced into the input end 10 of the drum 8 and are dried during conveyance toward the output end 12. Preferably, the particles are super-heated during conveyance, e.g. to a temperature of about 600° F., so that the heat within the particles may be transferred to RAP or additive particles introduced into the mixing chamber 72 as described below.

Upon reaching the slots 78 formed in the drum within the combustion zone 26, the aggregate particles fall into the outer mixing chamber and mix with RAP or additive particles which are introduced through the chute 60. Typically, RAP particles introduced into the mixing chamber are at or near ambient temperature, e.g. 70° F., and are quickly heated upon contacting the super-heated aggregate particle and the heated structure of the apparatus.

AS the RAP particles are heated, moisture within the particles evaporates and passes through the slots 78 into the drum with the hot gases and is treated in the air pollution control equipment after being delivered from the drum. As the RAP particles mix with the aggregate particles, the temperature of the aggregate and RAP particles equalize at an output temperature which may be controlled by controlling the super-heated temperature of the aggregate particles within the drum. Preferably, the output temperature of the composition is 300°–350° F., with 10–50% of the composition being RAP.

The length of the shell 18 is designed to permit materials to dwell within the mixing chamber for a sufficient amount of time to substantially evaporate all of the moisture within the materials being mixed. Thus, in applications where the materials have a high moisture content, the apparatus may be constructed with a shell having a longer length than would be necessary in applications where relatively dry materials are to be treated.

Upon being delivered from the mixing chamber 72 to the lifting zone 30, the composition of mixed materials are deposited on the conveyor 32 and advanced to a mixing device within which liquid asphalt is combined with the composition.

By introducing the RAP particles to the super-heated aggregate particles within the mixing chamber 72, increased amounts of RAP may be mixed with the aggregated particles while insuring that the RAP is heated for a sufficient amount of time to evaporate substantially all of the moisture therein before the composition is delivered to a mixing device for application of liquid asphalt. If moisture remains in the RAP when the composition is mixed with liquid asphalt, a degradation in the final product may result since stripping of the liquid asphalt from the particles could result. Thus, the apparatus of the invention permits an increase in the percentage of RAP that can be included in the mixture without detrimentally effecting the final asphalt composition.

Another application of the apparatus of the present invention is for remediating soil that contains contaminates such as hydrocarbons and the like. When the apparatus is used in this type of process, contaminated soil is introduced into the input end 10 of the drum 8 and is heated during conveyance toward the output end 12. The hydrocarbons within the soil are evaporated during conveyance of the soil and are delivered, with the hot gases, to a suitable filtration device, such as a baghouse, after exiting the input end of the drum.

Upon reaching the slots 78 formed in the drum within the combustion zone 26, the soil falls into the outer mixing chamber 72 and mixes with contaminated waste dust from the baghouse which is introduced through the chute. Typically, the dust includes hydrocarbons when introduced into the mixing chamber, and is quickly heated upon contacting the previously heated soil particles and the heated structure of the apparatus.

As the dust particles are heated, hydrocarbons within the particles evaporate and pass into and through the drum with the hot gases and are re-treated in the air pollution control equipment.

In addition to the use of the apparatus for remediating both soil and waste dust from a baghouse associated with the apparatus, it is also possible to add any other desirable materials into the soil by introducing the materials into the outer mixing chamber. For example, if it is desired to produce a soil of a predetermined gradation, particles of a desired composition may be added to the treated soil within the mixing chamber before the soil is delivered from the apparatus.

Although the invention has been described with reference to the preferred embodiment illustrated in the attached drawing figures, it is noted that substitutions may be made and equivalents employed herein without departing from the scope of the invention as recited in the claims. For example, in carrying out the process of the present invention, it is possible to employ an apparatus including an elongated drum having an input end and an output end, means for supplying hot gases to the drum at the output end and for directing the hot gases toward the input end, means for introducing a first particulate material into the drum adjacent the input end and for conveying the first particulate material toward the output end, and means for introducing a second particulate material into the drum adjacent the output end. Thus, in accordance with the process of the present invention, the use of an outer mixing chamber adjacent the output end of the drum, although preferred, is not necessary.

What is claimed is:

1. A method of heating and mixing a particulate material composition comprising the steps of:

supplying hot gases to a rotatable drum and directing the hot gases from a point of introduction through an interior space of the drum toward an input end of the drum;

introducing a first particulate material into the drum adjacent the input end and conveying the first particulate material in a direction counter to the direction of the hot gases toward the output end while heating the material and drum;

diverting the heated first particulate material into an outer mixing chamber by directing the first material through radially extending openings provided between the interior space and the outer mixing chamber, the heated first particulate material being diverted into the mixing chamber at a point upstream of the point at which the hot gases are supplied to the drum relative to the direction of conveyance of the first material;

introducing a second particulate material into the outer mixing chamber at a point upstream of the point of introduction at which the hot gases are supplied, and mixing the heated first particulate material with the second particulate material;

conveying the first and second particulate materials along the outer mixing chamber in a direction counter to the direction of the hot gases toward the output end of the drum while shielding the materials from the hot gases with flights that extend circumferentially over the openings;

heating the first and second particulate materials while the materials are moving through the outer mixing chambers, the second material being heated by contact with both the first particulate material and the heated drum while being shielded from the hot gases by the flights; and delivering the heated mixture of first and second materials from the outer mixing chamber and from the apparatus.

2. The method as recited in claim 1, wherein the first particulate material is heated to a super-heated temperature higher than the output temperature of the mixture during conveyance toward the output end of the drum.

* * * * *